United States Patent [19]

Meyer et al.

[11] 4,335,880

[45] * Jun. 22, 1982

[54] ELECTRIC EYE ACTUATED GUN ARCADE

[75] Inventors: Burton C. Meyer, Downers Grove; Gunars Licitis, Lombard; Derek A. Brand, Naperville, all of Ill.

[73] Assignee: Marvin Glass & Associates, Chicago, Ill.

[ * ] Notice: The portion of the term of this patent subsequent to Jul. 16, 1998, has been disclaimed.

[21] Appl. No.: 185,374

[22] Filed: Sep. 8, 1980

Related U.S. Application Data

[63] Continuation of Ser. No. 659,216, Dec. 19, 1976, Pat. No. 4,296,929.

[51] Int. Cl.[3] ..... A63F 9/02; F41J 5/02; F41J 5/06

[52] U.S. Cl. ..... 273/310

[58] Field of Search ..... 273/310–312, 273/119 R; 434/21, 22; 362/111–114; 124/66–68

[56] References Cited

U.S. PATENT DOCUMENTS

| | | | |
|---|---|---|---|
| 2,139,530 | 12/1938 | Vivaudou | 273/314 |
| 2,174,813 | 10/1939 | Younghusband | 273/312 |
| 2,254,952 | 9/1941 | Squire | 273/312 |
| 2,310,084 | 2/1943 | Hooker et al. | 273/312 |
| 3,220,732 | 11/1965 | Pincus | 273/312 |
| 3,675,925 | 7/1972 | Ryan et al. | 273/312 |
| 3,870,305 | 3/1975 | Harclerode | 273/11 |
| 3,891,216 | 6/1975 | Ensmann et al. | 273/119 R |

*Primary Examiner*—Vance Y. Hum

*Attorney, Agent, or Firm*—Mason, Kolehmainen, Rathburn & Wyss

[57] ABSTRACT

A target shooting apparatus including an operator controlled simulated gun which projects a light beam of short duration toward a target each time the trigger is actuated. The simulated gun must be cocked between each "shot" which also resets a recoiling mechanism to give a true to life operational effect to the gun. The target includes a frame fronted by a simulated fence on top of which a plurality of objects, such as bottles, tin cans, and the like may be placed. A target impeller is provided on the frame in proximity to each of the objects so that, when actuated, the impeller will cause physical movement of the associated target knocking it off of the frame. The target impellers are actuated by a control mechanism, as a photo transistor therein senses the proper alignment of the light beam from the gun through one of a plurality of apertures located on the frame below each of the objects. The control mechanism is slidably mounted on a downwardly canted guide rail by a carriage which moves from one target impeller to the next lower target impeller after actuation thereof. After all of the objects have been hit, the carriage is manually moved back to the top of the rail guide and each of the target impellers is manually reset for another play of the game.

4 Claims, 14 Drawing Figures

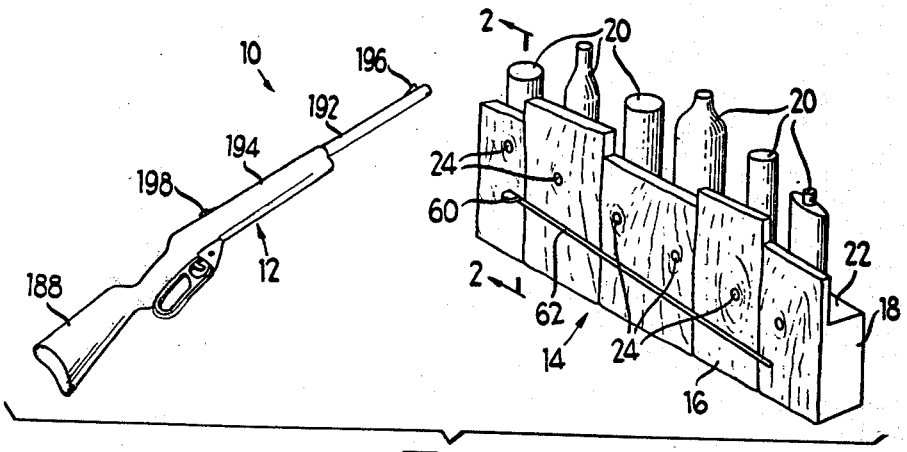
Fig 1
Fig 2
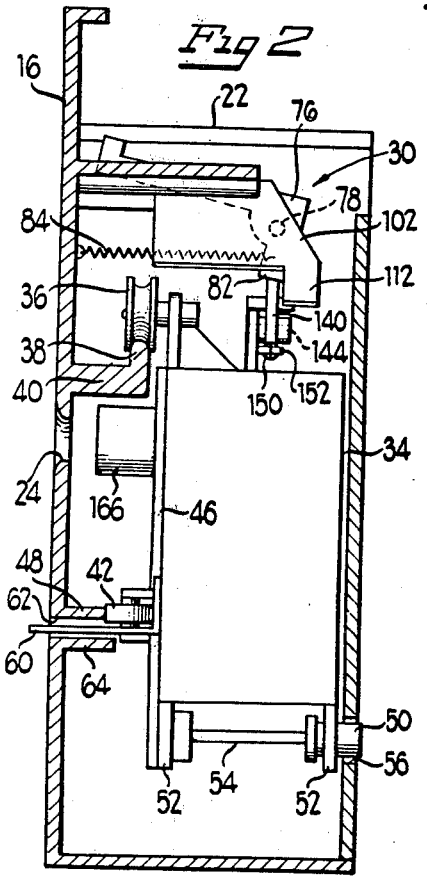
Fig 3
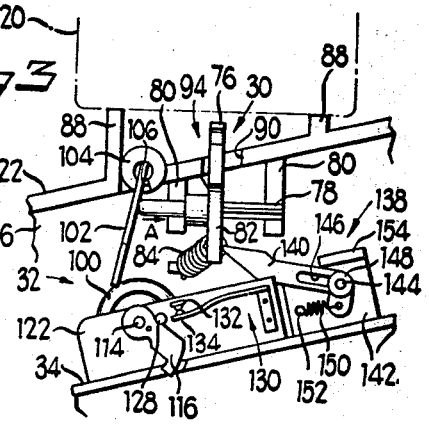
Fig 4
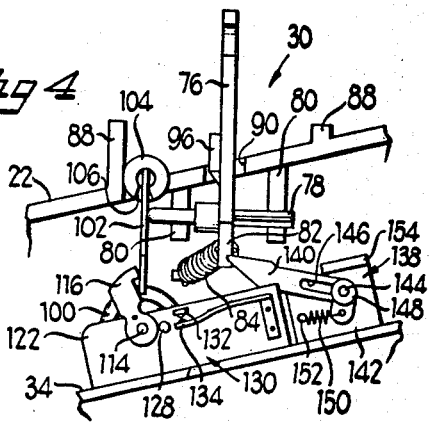

ELECTRIC EYE ACTUATED GUN ARCADE

This is a continuation of application Ser. No. 659,216, filed on Feb. 19, 1976, now U.S. Pat. No. 4,296,929.

BACKGROUND OF THE INVENTION

1. Field of the Invention

This invention relates to target shooting galleries and in particular to a target shooting apparatus which causes various objects to become dislodged by photoelectric means from a frame as if they were physically contacted by a projectile.

2. Brief Description of the Prior Art

Target shooting amusement devices for testing markmanship or other skills in which an image or target is projected onto a screen are well known. Heretofore, such devices, for the most part, merely have indicated when a simulated shooting or other aiming device was properly aligned with the actual or projected image. Such alignment was indicated by flashing lights, hits and misses scoring mechanisms, or similar visual or audio means. In other markmanship devices a mechanism was utilized in connection with a moving target, wherein the timing of the position of the image with the coincidents of the simulated projectile was accomplished by utilizing a large number of electrical contacts, or the like. Such devices often used a photocell or photo transistor which was actuated upon proper aiming of a light source to cause the target to be knocked down or otherwise physically disturbed. Additionally, these devices utilized specific, generally expensive, targets which included the photo cell thereon for sensing a simulated hit. The present invention provides a novel electronic target shooting device enabling optimum play value at substantially reduced cost.

SUMMARY OF THE INVENTION

The present invention provides a target shooting apparatus having a frame for removably supporting at least one target object. An actuatable target impeller is mounted on the frame in close proximity to each of the targets to produce a predetermined physical movement of the target upon actuation. An aiming device such as a simulated gun including means to provide a directed light beam of short duration is directed toward one of a plurality of apertures on the frame individually coordinated with the separate targets. A circuit means provides an output signal to a control means upon the sensing of a properly directed light beam from the aiming device. The control means actuates the target impeller in response to the output signal from the circuit means to cause the respective target to be knocked off of the frame.

BRIEF DESCRIPTION OF THE DRAWINGS

FIG. 1 is a perspective view of a target shooting apparatus embodying the concepts of the present invention;

FIG. 2 is a vertical section, on an enlarged scale, taken generally along the line 2—2 of FIG. 1;

FIG. 3 is a rear, fragmented elevational view of the target impeller means in its latched, preset position;

FIG. 4 is a rear, fragmented elevational view similar to FIG. 3 showing the target impeller in its released position;

DESCRIPTION OF THE PREFERRED EMBODIMENT

Figure 5:
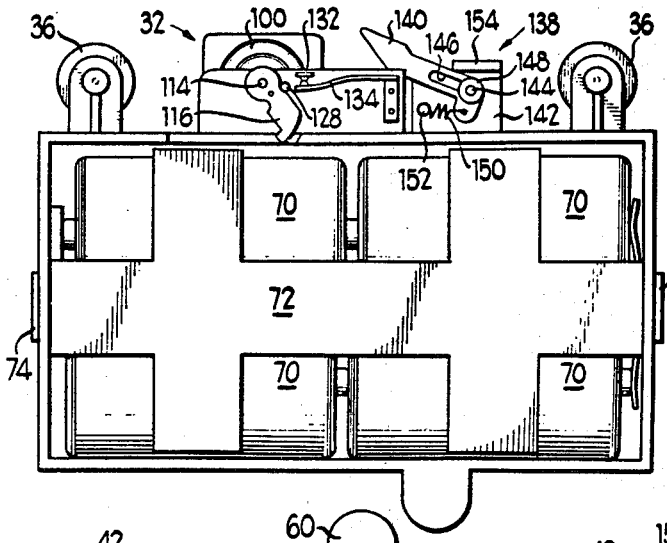
FIG. 5 is a rear elevational view of the carriage and control means of the present invention.
Figure 8:
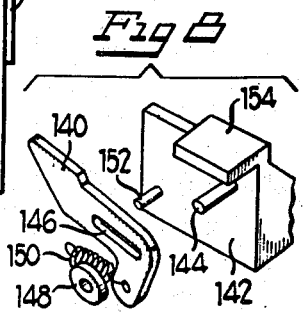
FIG. 8 is a fragmented perspective view, on an enlarged scale, of the carriage latch means.
Figure 6:
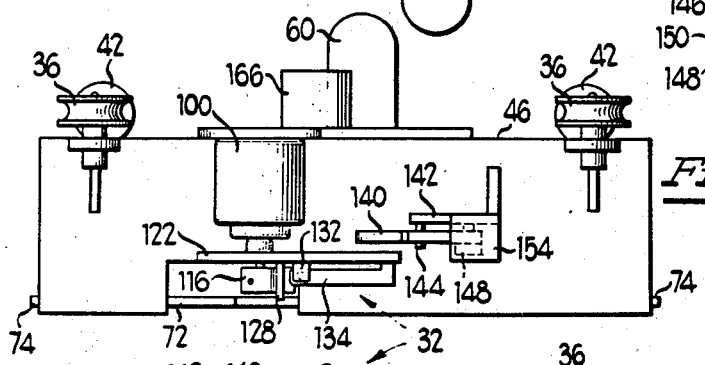
FIG. 6 is a top plan view of the carriage and control means of FIG. 5.

The target game apparatus of the present invention, generally designated 10, is shown in FIG. 1 to include an aiming device such as a simulated rifle, generally designated 12, and a target support frame, generally designated 14. The target support frame includes a simulated fence-like front wall 16 mounted on the front of a generally rectangular housing 18. A plurality of target objects 20 are mounted on a top wall 22 of the housing directly in back of the fence-like front wall 16. Generally, in operation, a light beam from the rifle 12 will enter through one of a plurality of apertures 24 in the fence 16 when the rifle is properly aimed at the respective target 20 to cause the target to be knocked off of the housing 18 as if actually hit by a projectile. The targets 20 must be "hit" in a sequential order from the left to the right as shown in FIG. 1, as will be described in greater detail hereinafter.

Referring to FIGS. 2 through 4, a plurality of target impellers, generally designated 30, one for each of the targets 20, are mounted on the housing 18 behind the fence for dislodging the target objects 20 therefrom. Each of the target impellers 30 is individually selectively actuatable, one at a time, by a control means, generally designated 32, mounted for generally transverse movement by a carriage 34. The carriage 34 is mounted by an upper pair of rollers 36 on a generally downwardly canted rail 38 secured by a flange 40 to the fence-like front wall 16. A pair of front rollers 42, mounted to a front wall 46 of the carriage, engage a rearwardly directed guide flange 48 on the fence-like front wall 16 to maintain the carriage 34 in a generally vertical orientation. A single, rear roller 50 is rotatably mounted in a pair of downwardly directed tabs 52 by an axle 54 to additionally aid in guiding the movement of the carriage 34. The roller 50 slides within a rearward slot 56 formed on the housing. A forwardly directed tab 60 on the front wall 46 of the carriage emerges through a slot 62 formed in the fence-like front wall 16 and is defined by the guide flange 48 and a lower guide flange 64.

The guide rail 38, slot 62, guide flange 48 and rear slot 56 all are parallel to one another in the same orientation as the slot 62 seen in FIG. 1. The carriage 34 thus is rollably supported to move, under the influence of gravity, from the upper lefthand end of the housing 16 to the lower righthand end of the housing as shown in FIG. 1. The carriage 34 is retained beneath each of the successive target objects 20 by the respective target impeller 30 and can only move to the next lower adjacent target impeller after successful actuation thereof by the user, as will be described below.

As seen in FIG. 5, the rectangular carriage 34 serves as a battery housing for mounting a plurality of batteries 70. The batteries 70 are connected in series, as will be described below.

As seen in FIG. 5, the rectangular carriage 34 serves as a battery housing for mounting a plurality of batteries 70. The batteries 70 are connected in series, as will be described with respect to the schematic of FIG. 14, and are maintained within the carriage by a double cross brace 72 which includes a pair of tabs 74 engageable with appropriate complementary apertures in the carriage 34 to facilitate replacement of the batteries 70.

One of the target impellers 30 is shown in FIGS. 2 through 4 to include a generally vertical contact arm 76 which is pivotally mounted by a generally horizontal pin 78 in a pair of downwardly directed flanges 80 depending from the underside of the top wall 22 of the housing 18. The contact arm 76 includes an L-shaped leg 82 which is connected by a spring 84 to the front wall 16 of the housing. The spring 84 biases the contact arm 76 to urge the arm from its set position, as shown in FIGS. 2 and 3, to its release position, as shown in FIG. 4.

Referring to FIG. 3, each target 20 is mounted in a generally vertical orientation by a pair of unequal support flanges 88 upstanding from the wall 22 so that the contact arm 76, which emerges through a slot 90 in the top wall 22, is normally out of engagement with the target object 20 when in the set position. Latch means, generally designated 94, maintain the contact arm 76 in its set position. The latch means 94 comprises a side tab 96 on each contact arm 76 which engages one side of the slot 90 to maintain the contact arm 76 in its set position. The contact arm is released, and thus the impeller 30 is actuated, by horizontal sliding of the pin 78 within its journals generally in the direction of arrow A as shown in FIG. 3. This horizontal movement of the contact arm 76 permits the tab 96 to disengage the slot 90 thereby permitting the spring 84 to pivot the contact arm about the pin 78. This pivotal movement permits the contact arm 76 to engage the target object 20 and physically dislodge the object while additionally providing an impinging sound against the object as would normally be heard when a projectile would contact the object. This feature provides additional realistic characteristics for the target game apparatus of this invention.

Actuation of the target impeller 30 is accomplished by the control means 32. The control means 32 includes a small electric motor 100 which is positioned generally under each of the respective target impellers 30 prior to actuation thereof. A generally rectangular actuating arm 102 is pivotally mounted adjacent each actuator by a cylindrical hinge 104 in a longitudinal slot 106 to depend generally downwardly in proximity to the motor 100. The actuator 102 engages one end of the pivot pin 78 and includes a downwardly extending tab portion 112 adjacent the end of the motor shaft 114. A rotating arm 116 is mounted on the end of the motor shaft 114 so as to rotate in coincident path with the tab 112 so that, when the motor is energized, the arm 116 will engage the actuator plate 102 and, with continued rotation of the shaft 114, move the actuator plate 102 from the position shown in FIG. 3 to the position shown in FIG. 4. This movement, as described above, moves the pin 78 in the direction of arrow A, thus releasing the latch 95 to permit physical movement of the target object 20 under the force of the biasing spring 84.

Figure 9:
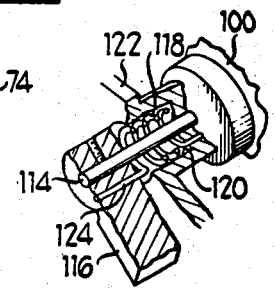
FIG. 9 is a fragmented partial sectional view, on an enlarged scale, of the control means actuator.
Figure 7:
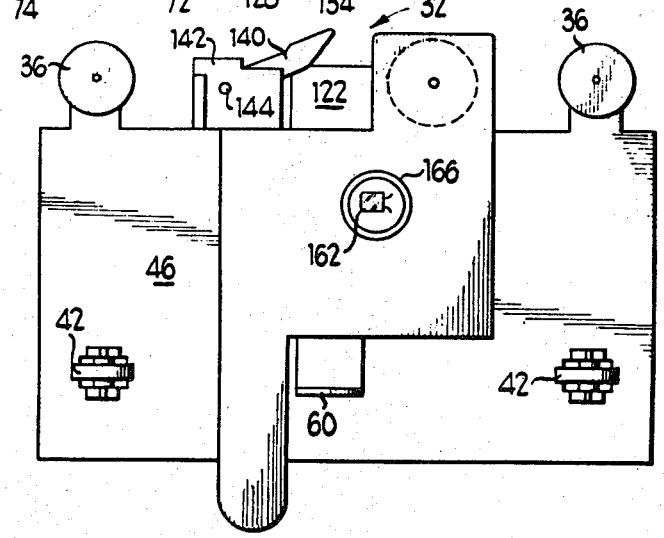
FIG. 7 is a front elevational view of the carriage and control means of FIG. 5.

The energization of the motor will be described in detail hereinafter with respect to the electronic diagram of FIG. 14. However, for a complete and distinct explanation, the operation of the motor will be described with reference to FIGS. 3, 4 and 9. The motor shaft and arm 116 are biased toward the position as shown in FIG. 3 by a coil spring 118 (FIG. 9) wrapped about the shaft 114. One end of the spring is securely fastened within a recess 120 formed on an upwardly extending flange 122 on the carriage 34. The other end 124 of the spring is embedded within the arm 116 and constantly biases the arm and motor shaft toward the position shown in FIG. 3 against the stop pin 128 in the flange 122.

Switch means, generally designated 130, including an upper stationary contact 132 and a lower flexibly movable contact 134, is mounted adjacent the motor 100 on the flange 122 and is normally maintained in the closed position shown in FIGS. 3 and 4 by the flexible contact 134. The switch means 130 is wired in series with the motor and upon energization of the motor, the arm 116 rotates to actuate the target impeller, as previously described, as the arm continues to rotate whereat the end thereof engages the flexible contact 134 to break the contact and thus open the circuit to the motor. This de-energizes the motor and permits the coil spring 118 to rotate the arm 116 back to its beginning position as shown in FIG. 3. The motor performs the same two-directional rotation during all subsequent energizations thereof for actuation of the respective target impellers.

Retaining means, generally designated 138 (FIGS. 3 and 4), is provided on the carriage to retain the carriage in a position below each target impeller 30 until actuation thereof. The retaining means 138 includes an L-shaped arm 140 which is pivotally mounted on another upstanding flange 142 by a forwardly directed pin 144. The pin 144 passes through a slot 146 in the arm 140 while a washer or other securing means 148 maintains the arm on the pin. The arm 140 is biased in a counterclockwise direction by a spring 150 between the leg of the arm 140 and a second pin 152 on the flange. The clockwise rotation of the arm 140 is limited by a forwardly directed flange 152 on the top of the flange 142. Referring to FIG. 3, before the control arm 76 of the target impeller 30 is actuated, the depending leg 82 thereof engages the free end of the arm 140 and retains the carriage in the position as shown in FIG. 3. However, upon actuation of the contact arm 76, the leg 82 moves out of engagement with the arm 140 as shown in FIG. 4, thus permitting the entire carriage 34 to roll due to gravity down the rail 38 until the arm 140 engages the next lower adjacent target impeller 30. The sequence is then repeated seriatim for each of the target impellers until the last or rightmost target object 20 is successfully knocked off of the housing. When this occurs, the carriage 34 is manually moved by the protruding tab 60 to the top or highermost point of the rail 38 and each of the respective target impellers are manually reset for another round of practice.

Circuit means, generally designated 160 (FIG. 14), is mounted on the carriage 34 to travel with the control means 32 to eliminate the expense and necessity of a plurality of circuits, for each target object 20. More particularly, the circuit means 160 includes a photo transistor 162 which is mounted on the front wall 46 of the carriage in alignment with the respective apertures 24 as the carriage is retained by the retaining means 138. A generally tubular enclosure 166 is provided for the photo transistor 162 to prevent stray or ambient light from actuating the circuit and acts to effectively aim the photo transistor sensitivity at the apertures 24. The collector of the photo transistor is connected to the positive side of the power supply (batteries 70) which are mounted on the carriage, as described above. The emitter of the photo transistor 162 is connected to one side of a potentiometer 166 while the other side of the potentiometer is connected to the negative terminal of the power supply. The collector of the photo transistor 162 also is connected to the stationary contact 132. The flexible contact 134 is connected to one terminal of the motor while the other end of the motor is connected to the anode of a controlled rectifier 168. The cathode of the controlled rectifier is connected to the negative terminal of the power supply 70. The gate of the controlled rectifier 170 is connected through a resistor 172 to an adjustable arm or wiper 174 of the potentiometer 166. As discussed previously with respect to FIG. 3, the contacts 132 and 134 are in a normally closed position prior to actuation of the circuit means 160. The potentiometer arm 174 is adjusted to assure that the ambient light striking the photo transistor 162, through the aperture 24, will not cause sufficient current to flow therethrough to generate enough voltage at the gate of the controlled rectifier to cause it to switch on. This enables use of the target shooting apparatus under various lighting conditions.

When the rifle 12 is correctly aimed at one of the target objects 20, a light source therein, generally designated 180 (FIG. 10), causes a flash of light from the rifle to be directed through the respective aperture 24 to strike the photo transistor 162. The light thereby striking the photo transistor 162 causes the photo transistor to conduct and therefore raises the voltage at the gate 170 of the controlled rectifier. This increase in voltage is of a sufficient level to cause the controlled rectifier to "switch on" or conduct which thereby energizes the motor 100 with the following actuation of the target impeller, as described above. When the arm 116 engages the flexible contact 134 the opening of the switch 130 will commutate the controlled rectifier 168 thereby resetting the circuit for the next flash of light through the next subjacent aperture 24. Then as described above, the motor biasing spring 118 will return the arm 116 to its beginning position as shown in FIG. 3. The following closure of the switch means 130 will not energize the motor until the controlled rectifier 168 is again switched on. Numerous equivalent electronic components may be used as functional replacements for the photo transistor 162 and the controlled rectifier 168 without departing from the spirit of this invention.

Figures 10, 11, 12, 13, 14:
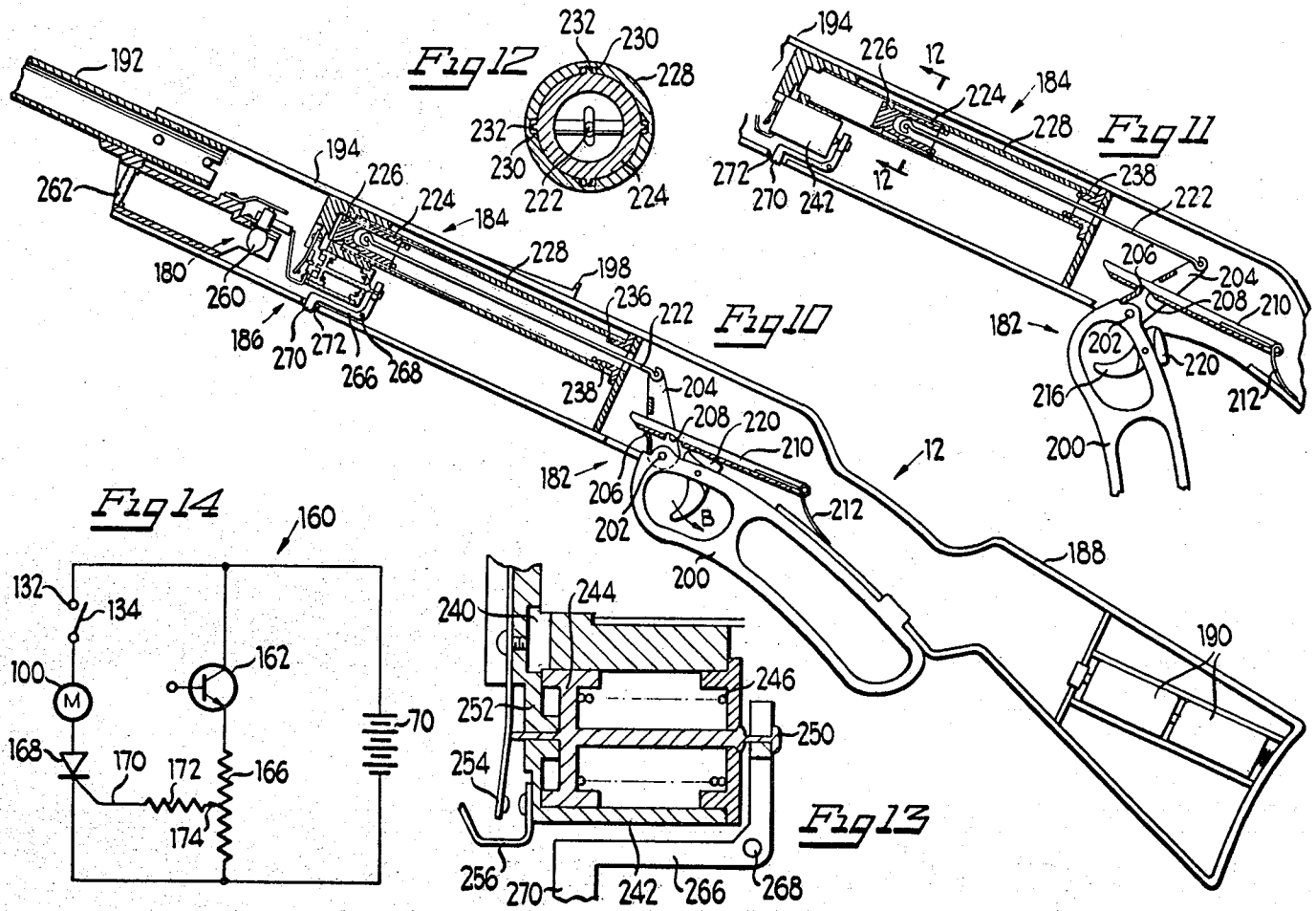
FIG. 10 is a fragmented vertical section, on an enlarged scale, along the longitudinal axis of the simulated rifle of FIG. 1.
FIG. 11 is a fragmented section similar to FIG. 10 showing the recoil mechanism of the rifle being cocked.
FIG. 12 is a vertical section, on an enlarged scale, taken generally along the line 12—12 of FIG. 11.
FIG. 13 is a fragmented vertical section, on an enlarged scale, of a portion of the rifle of FIG. 10.
FIG. 14 is a schematic view of the light sensing motor activating circuitry of the control means.

The aiming device or rifle 12 is shown in section in FIGS. 10 through 13. The rifle includes a cocking mechanism, generally designated 182, a recoil producing mechanism, generally designated 184, and switch means, generally designated 186, for energizing the light means 180. More particularly, the rifle includes a generally hollow butt or rear stock portion 188 which serves as a battery casing for a pair of batteries 190 for energizing the light means 180. A simulated barrel 192 extends forwardly of a forward stock portion 194 and includes a sighting tip 196 on the end thereof which aligns with a view finder 198 on the stock. When properly aimed at one of the target objects 20, the light means 180 of the rifle will produce a light beam of short duration through the respective aperture 24 to actuate the target impeller. The cocking mechanism 182 includes a cocking handle 200 which is pivotally mounted to the stock 194 by a pin 202. A lever 204 also is pivotally mounted by the pin so as to move in a clockwise direction with the cocking arm as shown by the movement between FIGS. 10 and 11. The lever 204 includes a flaired portion 206 which engages a notch 208 in a retaining arm 210. The retaining arm 210 is mounted to the rifle butt 188 by a leaf spring 212. The retaining arm 210 will maintain the lever 204 in its cocked position as shown in FIG. 11 when the cocking arm is returned to its normal position as shown in FIG. 10. A trigger 216 is eccentrically, pivotally mounted to the cocking handle 200 in a position, in engagement with the retaining arm 210. As the trigger is pulled and pivoted in a counterclockwise direction as shown by arrow B in FIG. 10, the top end 220 thereof, because of the eccentric mounting, will engage the retaining arm 210 thereby lifting it to release the lever 204.

A connecting rod 222 is pivotally connected to the upper end of the lever 204 at one end and also pivotally connected to a piston 224 at the other end. The piston 224 is closed by a cap 226 on its forward end and slides within a cylinder 228. A plurality of guide grooves 230 within the cylinder 228 engage a similar plurality of fins 232 on the piston 224 to retain proper orientation. A substantially resilient coil spring 236 is mounted within the cylinder between the piston 224 and a rear cap 238 so that, during cocking of the arm 200, the piston 224 is drawn back by the lever 204 and retained thereat by the retaining arm 210, as shown in FIG. 11. Pulling of the trigger, as described above, releases the piston 224 which moves forward under the force of the spring 236 thereby giving a recoil effect to the rifle while compressing air in the forward end of the cylinder 228. The compressed air is utilized to energize the light means 180, as described below.

The forward end of the cylinder 228 is in communication with an air inlet 240 (FIG. 13) at the front end of the cylinder 228. The air inlet 240 is in communication with a second air tight cylinder 242. A second movable piston 244 within the cylinder 242 is biased by a larger, less resilient coil spring 246 toward the forward end of the cylinder 242. A forwardly and rearwardly directed actuating pin 250 is secured to the piston 244 for energizing the light means 180. The pin 250 extends forwardly through a front cylinder cap 252 to engage a flexible contact 254. A stationary contact 256 is mounted behind the flexible contact 254, both of which are wired in series with a small lightbulb 260 and the batteries 190. The pin 250, under normal conditions, is biased by the spring 246 to maintain the contacts 254 and 256 out of contact. When the compressed air from the cylinder 228 is passed through the inlet 240 to the second cylinder 242, the piston 244 moves rearwardly, due to the air pressure, thus permitting the contacts 254 and 256 to engage and intermittently illuminate the lightbulb 280. A lens 262 is mounted forwardly of the lightbulb 260 (FIG. 10) to focus the light generated by the lightbulb 260 onto a sufficiently small area so that its intensity will be enough to activate the photo transistor 162. However, note that the lens must have a broad enough image so as to permit coverage of all of the apertures 24 when the rifle is aimed at the respective target objects 20.

A test lever 266 is pivotally mounted by a pin 268 within the stock 194. The upper end of the test lever 262 is connected to the pin 250 while the lower end 270 extends through an aperture 272 in the lower side of the stock 194. By depressing the end 270 of the test lever, a user may close the contacts 254 and 256 to illuminate the light in order to check the batteries or the lightbulb 260. Each time the gun is "fired", it again must be cocked before firing. Thus, the target game of the present invention provides an aiming device which emits a light signal of short duration which can be received by one circuit means 160 to actuate a target impeller to dislodge one of a plurality of target objects 20. The same circuit means 160 and the control means 32 move along with the carriage 34 to actuate each of the target impellers 30 thus providing a less expensive and more exciting target game.

The foregoing detailed description has been given for clearness of understanding only and no unnecessary limitations should be understood therefrom as some modifications will be obvious to those skilled in the art.

We claim:

1. A target shooting apparatus, comprising:

a plurality of target devices;

a frame removably supporting said target devices;

a selectively actuable target ejector means for forcibly and physically ejecting a target off of said frame when said ejector means is actuated;

a selectively operable means for providing light of a predetermined intensity;

circuit means including a phototransistor remotely disposed from said targets providing an output signal upon the sensing of light of a predetermined intensity;

control means operatively associated between said circuit means and said target ejector means for actuation of the ejector means in response to the output signal from said circuit means; and carriage means mounting said circuit means and control means for movement between said targets wherein the control means is adjacent the respective target ejector means.

2. The target shooting apparatus of claim 1 wherein said frame includes a plurality of apertures, one for each target device, and said phototransistor is mounted on said carriage means for alignment with one of said apertures associated with a target device.

3. The target shooting apparatus of claim 1 or 2 wherein said selectively operable means for providing light of a predetermined intensity comprises a simulated gun.

4. The target shooting apparatus of claim 3 wherein said frame is a simulated fence.

* * * * *